US012071716B2

(12) United States Patent
Silvan et al.

(10) Patent No.: US 12,071,716 B2
(45) Date of Patent: Aug. 27, 2024

(54) ACTUATOR ASSEMBLY FOR A TEXTILE MACHINE

(71) Applicant: TEXTILMA AG, Stansstad (CH)

(72) Inventors: Borer Silvan, Stansstad (CH); Herzog Lothar, Stansstad (CH); Krasovskyy Andriy, Stansstad (CH); Schlienger Marco, Stansstad (CH); Weber Thomas, Stansstad (CH)

(73) Assignee: TEXTILMA AG, Stansstad (CH)

( * ) Notice: Subject to any disclaimer, the term of this patent is extended or adjusted under 35 U.S.C. 154(b) by 143 days.

(21) Appl. No.: 17/352,947

(22) Filed: Jun. 21, 2021

(65) Prior Publication Data

US 2021/0388542 A1 Dec. 16, 2021

(30) Foreign Application Priority Data

Jun. 19, 2020 (IT) ..... 102020000014749

(51) Int. Cl.
*D03C 13/00* (2006.01)

(52) U.S. Cl.
CPC ..... *D03C 13/00* (2013.01); *D03C 2700/0194* (2013.01); *D10B 2403/0311* (2013.01)

(58) Field of Classification Search
None
See application file for complete search history.

(56) References Cited

U.S. PATENT DOCUMENTS 3,472,287 A * 10/1969 Ribler ..... D04B 27/32 139/319
5,514,960 A * 5/1996 Taverner ..... H02K 37/14 324/144
6,079,455 A * 6/2000 Speich ..... D03C 13/025 139/55.1
7,806,146 B2 * 10/2010 Borer ..... D03C 13/00 139/65

(Continued)

FOREIGN PATENT DOCUMENTS

DE 2166585 A1 * 9/1974 ..... D03C 13/00
EP 1016743 A1 * 7/2000 ..... D03C 11/00

(Continued)

OTHER PUBLICATIONS

Search report received in IT Application No. 202000014749, Dated Mar. 5, 2021, pp. 8.

*Primary Examiner* — Grace Huang
(74) *Attorney, Agent, or Firm* — Gearhart Law, LLC; David Postolski

(57) ABSTRACT

The invention relates to an actuator assembly 20 for a textile machine 22, wherein: the actuator assembly comprises a plurality n of spools 24 distributed along depth d; the actuator assembly comprises a plurality n+1 of magnetic plates 26 distributed along depth d; the magnetic plates and the spools are alternated along depth d such that each spool is received between two adjacent magnetic plates; each magnetic plate comprises an upper permanent magnet 28 and a lower permanent magnet 30 having opposed orientation; the upper permanent magnets of all the magnetic plates (Continued)

have the same orientation; the lower permanent magnets of all the magnetic plates have the same orientation; each spool is movable along height h between an upper position and a lower position and vice versa.

21 Claims, 9 Drawing Sheets

(56) References Cited

U.S. PATENT DOCUMENTS

| | | | | |
|---|---|---|---|---|
| 8,418,302 | B1 * | 4/2013 | Suen | A61C 17/3418 310/36 |
| 9,091,001 | B2 * | 7/2015 | Graham | D03C 3/00 |
| 2018/0002841 | A1 | 1/2018 | Vanheesbeke | |
| 2022/0186808 | A1 * | 6/2022 | Hartgers | H01F 7/066 |

FOREIGN PATENT DOCUMENTS

| | | | | | |
|---|---|---|---|---|---|
| EP | 1024214 | A1 | | 8/2000 | |
| JP | 03069626 | A | * | 3/1991 | D03C 3/20 |
| JP | 10298842 | A | * | 11/1998 | D03C 13/00 |
| JP | H10298842 | A | | 11/1998 | |

* cited by examiner

ACTUATOR ASSEMBLY FOR A TEXTILE MACHINE

This application is a U.S. Nonprovisional Application under 35 USC 111(a) which claims priority to Italian Application No. 102020000014749 filed on Jun. 19, 2020, the contents of which is hereby fully incorporated by reference in its entirety.

FIELD OF THE EMBODIMENTS

The present invention relates to an actuator assembly for a textile machine, and to a textile machine comprising such actuator assembly.

BACKGROUND OF THE EMBODIMENTS

In a manner widely known per se, the textile machines are suitable for transforming one or more threads into a textile product (for example a fabric, a mesh, a ribbon or the like). In the following description reference will be made to a machine for weaving ribbons. Such reference has to be considered as having an exemplifying intent rather than a limiting one and, as the skilled person can easily understand, the invention can be used also in other similar machines.

The operation of the weaving machines implies, in a known manner, that in the working area the warp threads are moved (raised and lowered) in an alternating manner, and that the weft threads are passed through the opening (shedding) which is formed between the warp threads. In a manner known per se, the warp threads are moved by means of heddles, according to a predefined weaving pattern, while the weft threads are moved by weft members which can assume different forms in the different types of textile machine.

In the ribbon weaving machines, the heddles are mounted on specific frames and are moved by means of an electro-mechanical actuator assembly which is briefly described below with respect to its essential features.

In a known manner, the actuator assembly comprises a plurality of electro-mechanical linear actuators, each of which comprises a spool slidingly mounted between two magnetic plates. Each of the magnetic plates comprises a couple of permanent magnets oriented in an opposed manner. Moreover, each spool is mounted on respective leaf springs. In the equilibrium position, in which the springs are undeformed, the spool is halfway between the two couples of magnets. When the spool is powered in a first way, the electro-magnetic field it generates tends to align to a first couple of magnets, and therefore it moves from the equilibrium position deforming the springs. Then, when the electric power supply of the spool is inverted, also the electro-magnetic field it generates is inverted, such that it tends to move for aligning to the second couple of magnets. During the first portion of the movement the springs unload, providing a force which is concurrent with the one generated by the electro-magnetic field. Conversely, in the second portion of the movement, after having passed the equilibrium position, the springs deform again in the opposed way. By inverting again the electric power supply to the spool, the movement is obtained again, and so on.

A solution of this type is disclosed, for example, in the patent document EP 2 069 564 and US 2009/277529 A1, in the name of the same Applicant. Such solution, even if it is widely used and appreciated, is not without drawbacks.

In the structure described above, the distance between two adjacent magnetic plates is defined by the depth of the respective springs. In facts, in view of the entity of the involved forces, the depth of the springs is larger than that of the spool and of the relative couples of magnets. This is why, in order to limit as much as possible the overall depth of the actuator assembly and thus the depth of the working area of the machine, the spools are arranged in an alternated manner, for example the spools in the even positions are arranged above the heddles and the spools in the odd positions are arranged under the heddles (see FIG. 1).

In this respect it is worth to be noticed also that, in view of a given space required by the weft members in their movement between the warp threads, the larger is the overall depth of the actuator assembly, the larger has to be necessarily the vertical stroke of each heddle frame in order to avoid any interference between the warp threads and the weft members. This is also why it is preferable that the overall depth of the actuator assembly is as small as possible.

As can be seen from FIG. 4 of EP 2 069 564 and US 2009/277529 A1, the alternated arrangement of the spools allows to limit the overall depth of the actuator assembly but it also remarkably increases its height. Of course, the large overall height of the actuator assembly affects the overall size of the weaving machine.

SUMMARY OF THE EMBODIMENTS

The object of the present invention is therefore that of overcoming the drawbacks pointed out above with respect to the prior art.

In particular, a task of the present invention is that of providing an actuator assembly for textile machines, having an overall size smaller than the known ones.

Lastly, a task of the present invention is that of providing an actuator assembly for textile machines which, further to allow the advantages described above, also maintains the functionality of the known solutions. Such object and such tasks are obtained by means of an actuator assembly according to claim 1 and by means of a textile machine according to claim 20.

BRIEF DESCRIPTION OF THE DRAWINGS

In order to better understand the invention and appreciate its advantages, some of its exemplifying and non-limiting embodiments are disclosed below, making reference to the attached drawings, wherein.

DESCRIPTION OF THE PREFERRED EMBODIMENTS

Figure 2:
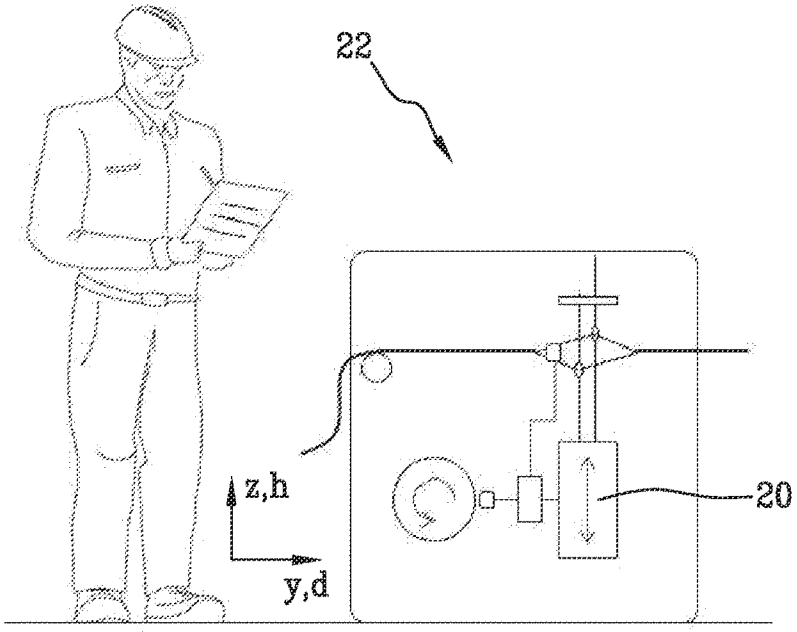
FIG. 2 schematically shows a side view of a ribbon weaving machine according to the invention.

In the scope of the present description, some terminological conventions have been assumed in order to make the reading easier and more fluid. Such terminological conventions are clarified below with reference to the attached figures, wherein the textile machine is shown in its proper orientation for operation.

Since the invention is to be used in presence of gravity acceleration, it is intended that the latter univocally defines the vertical direction. Analogously it is intended that, based on gravity acceleration, the terms "upper", "above" and the like are univocally defined with respect to the terms "lower", "below" and the like.

The vertical direction further defines the horizontal plane. With respect to the properly oriented textile machine, the horizontal plane is called below plane xy, where direction y (also said direction of depth d) is the one parallel to the main development of warp and of the textile product under processing, while direction x (also said direction of width w) is the one parallel to the main development of weft and thus perpendicular to direction y.

Again with respect to the textile machine, when it is properly oriented, also the vertical direction z is defined (also said direction of height h). The directions x, y and z form a right-handed Cartesian triad.

As the skilled person can easily understand, the conventions adopted herein have only the aim of simplifying the drafting and of rendering the reading smoother. Nothing would have changed if different conventions were adopted in the description of the invention.

The invention relates an actuator assembly 20 for a textile machine 22, having a width w, a depth d and a height h, wherein:

- the actuator assembly 20 comprises a plurality n of spools 24 distributed along depth d;
- the actuator assembly 20 comprises a plurality n+1 of magnetic plates 26 distributed along depth d;
- the magnetic plates 26 and the spools 24 are alternated along depth d such that each spool 24 is received between two adjacent magnetic plates 26;
- each magnetic plate 26 comprises an upper permanent magnet 28 and a lower permanent magnet 30 having opposed orientation;
- the upper permanent magnets 28 of all the magnetic plates 26 have the same orientation;
- the lower permanent magnets 30 of all the magnetic plates 26 have the same orientation;
- each spool 24 is movable along height h between an upper position and a lower position and vice versa, wherein the upper position is at least partially comprised between the upper permanent magnets 28 of the two adjacent magnetic plates 26 and the lower position is at least partially comprised between the lower permanent magnets 30 of the two adjacent magnetic plates 26; and
- each spool 24 can be electrically powered in two opposed ways.

Preferably, the upper position is fully comprised between the upper permanent magnets 28 of the two adjacent magnetic plates 26 and the lower position is fully comprised between the lower permanent magnets 30 of the two adjacent magnetic plates 26.

As the skilled person can easily understand from what is briefly reported above, the actuator assembly 20 of the invention comprises n linear actuators 32, each formed by one spool 24 and by the two magnetic plates 26 adjacent thereto. Of course, each magnetic plate 26 with the exception of the first and the last one, is part of two linear actuators 32 at the same time.

Advantageously, each magnetic plate 26 has generally a prevailing development in plane xz and comprises a frame structure 34 inside which the permanent magnets 28, 30 are mounted. Preferably the frame structure 34 is made of a material which does not interfere with the magnetic field generated by the permanent magnets 28, 30, for example of an amagnetic or a paramagnetic material. For example, the frame structure 34 can be made of a polymer, of a composite material or of aluminium.

Figure 6:
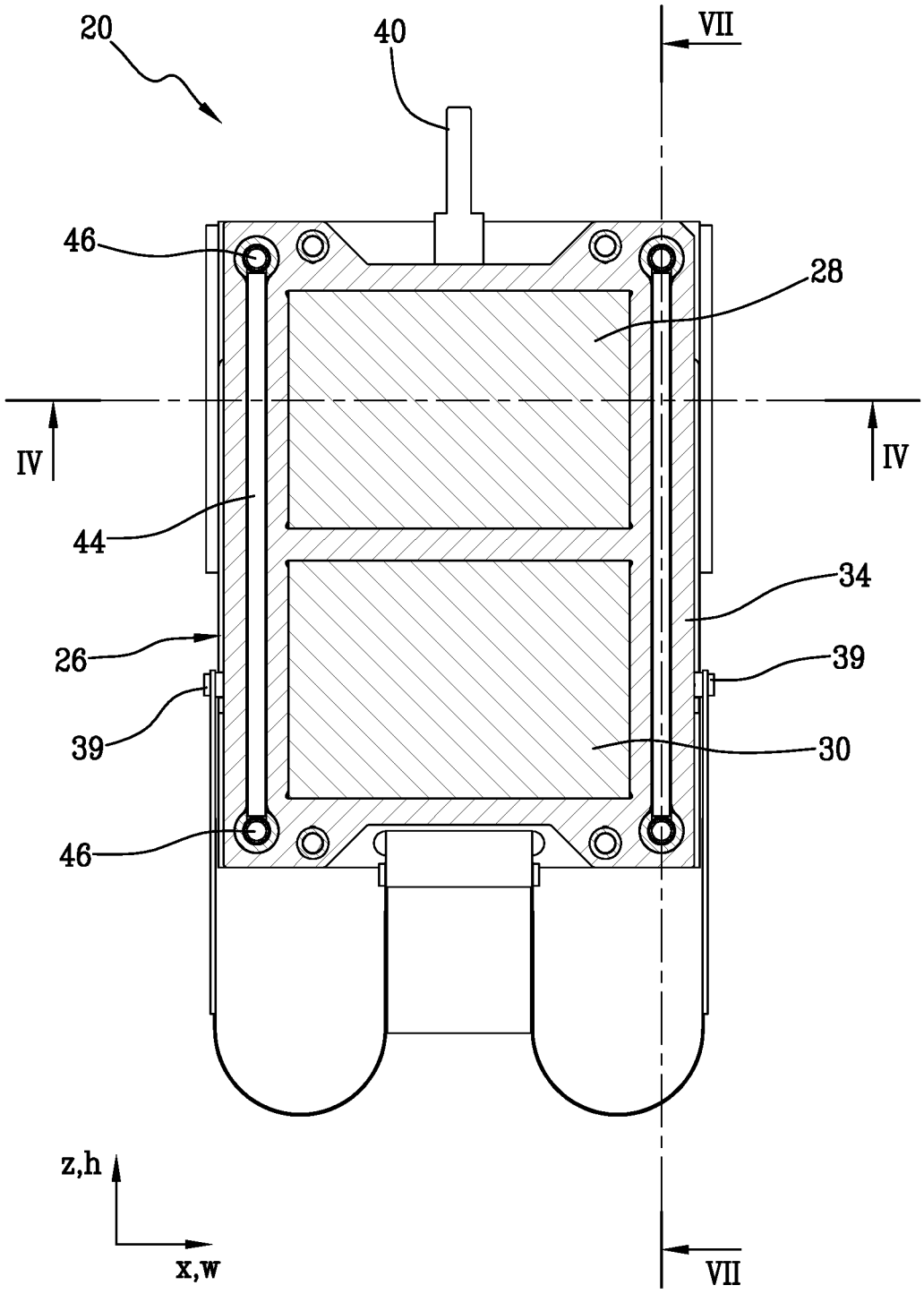
FIG. 6 shows a view of the cross section taken along line VI-VI of FIG. 4.
Figure 7:
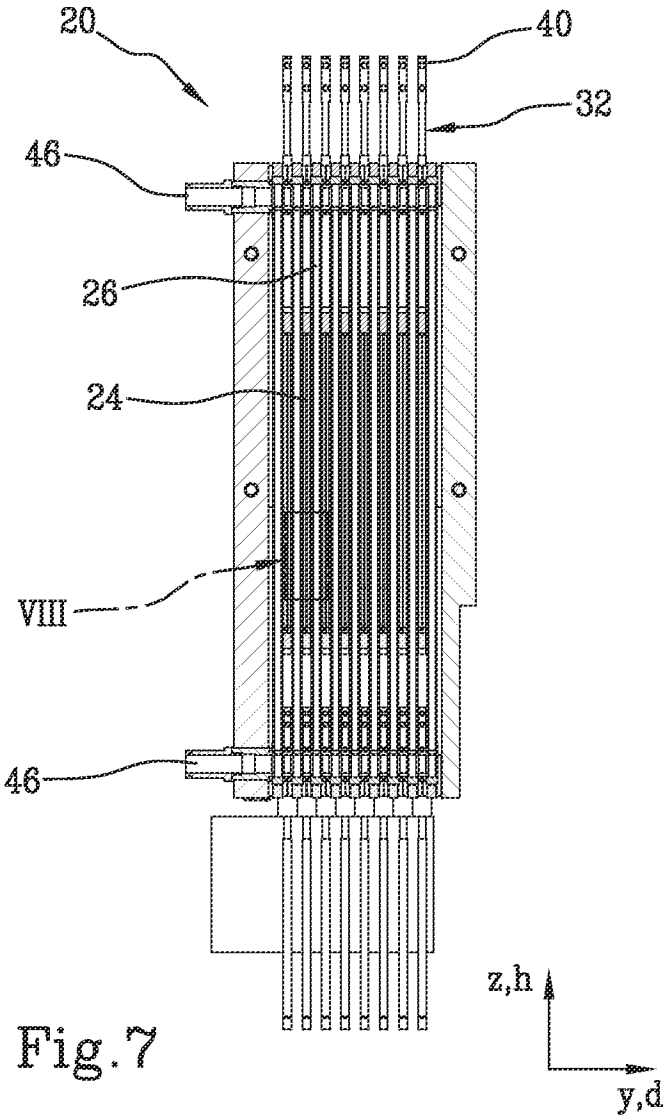
FIG. 7 shows a view of the cross section taken along line VII-VII of FIG. 6.

Advantageously, the permanent magnets 28, 30 comprised in the magnetic plates 26 have a main development in plane xz. More particularly, the permanent magnets 28, 30 have width along width w and height along height h decidedly larger than their depth along depth d. In this respect, FIG. 6 and FIG. 7 can be compared the one with the other, being drawn at the same scale. In FIG. 6 width and height can be appreciated of two permanent magnets, respectively upper 28 and lower 30, of a magnetic plate 26. In FIG. 7 depth can be appreciated of each of the magnetic plates 26 and of the spools 24, alternated among them. Within the depth of each magnetic plate 26 the depth of the respective permanent magnets 28, 30 is comprised.

Again with reference to FIGS. 6 and 7, orientation of the permanent magnets 28, 30 is described in greater detail. As briefly reported above, in each magnetic plate 26 the upper permanent magnet 28 and the lower permanent magnet 30 have opposed orientations. In other words, with reference to FIG. 6, if for example the visible surface of the upper permanent magnet 28 represents its north pole, then the visible surface of the lower permanent magnet 30 represents its south pole, or vice versa. From this fact derives that the magnetic field generated by the two permanent magnets 28, 30 visible in FIG. 6 is perpendicular to the plane of the drawing, entering in one case and exiting in the other case.

Moreover, as briefly reported above, the upper permanent magnets 28 of all the magnetic plates 26 have the same orientation among them and, respectively, the lower permanent magnets 30 of all the magnetic plates 26 have the same orientation among them. In other words, with respect to FIG. 7, if for example the upper permanent magnets 28 generate a magnetic field oriented from left to right, then the lower permanent magnets generate a magnetic field oriented from right to left, or vice versa. As the skilled person can easily understand, even in absence of the field lines in FIG. 7, the magnetic fields generated by the upper permanent magnets 28 and by the lower permanent magnets 30 close the one on the other outside the actuator assembly 20.

Preferably, each magnetic plate 26 comprises two metal foils 36 (see in particular FIG. 8) which extend in the plane xz and cover the permanent magnets 28, 30. In this manner a smooth and wear-resistant surface is obtained. Moreover, the metal foils 36 allows an effective spreading of heat, the advantages of which will be clear in view of the description below.

Figure 5A:
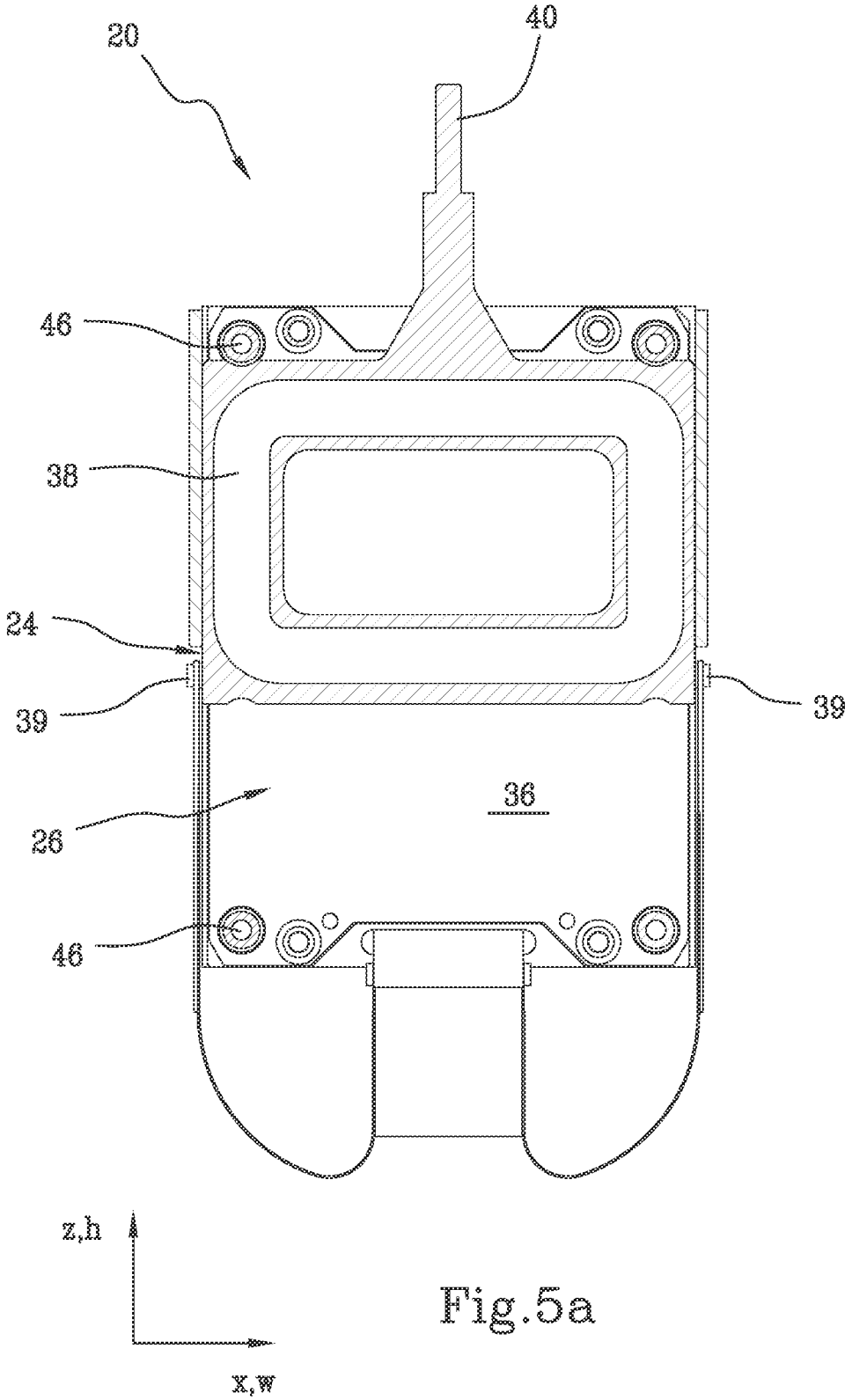
FIG. 5*a* shows a cross section taken along line V-V of FIG. 4.
Figure 5B:
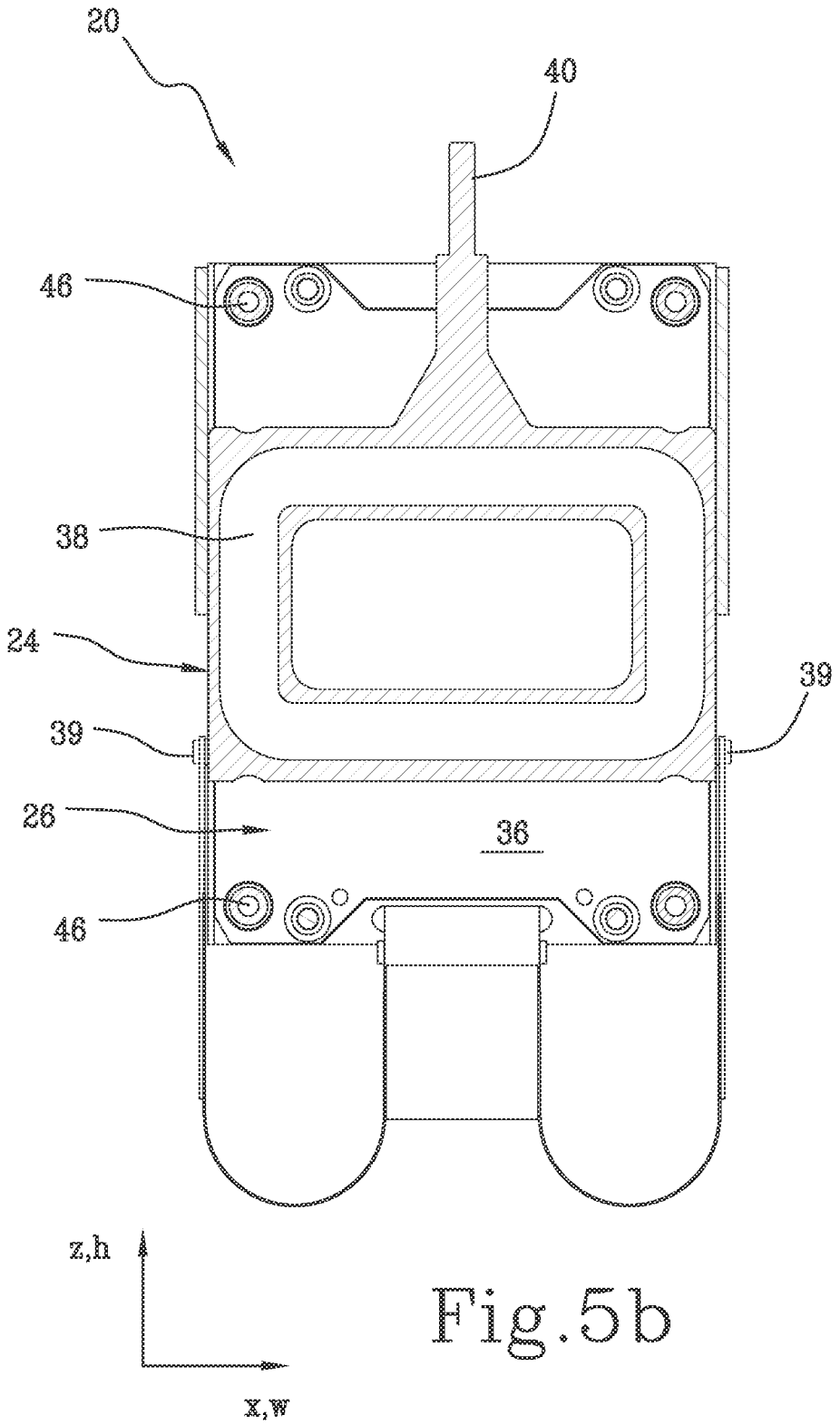
FIG. 5*b* shows the cross section of FIG. 5*a*, at a different positioning of the spool with respect to the permanent magnets.
Figure 5C:
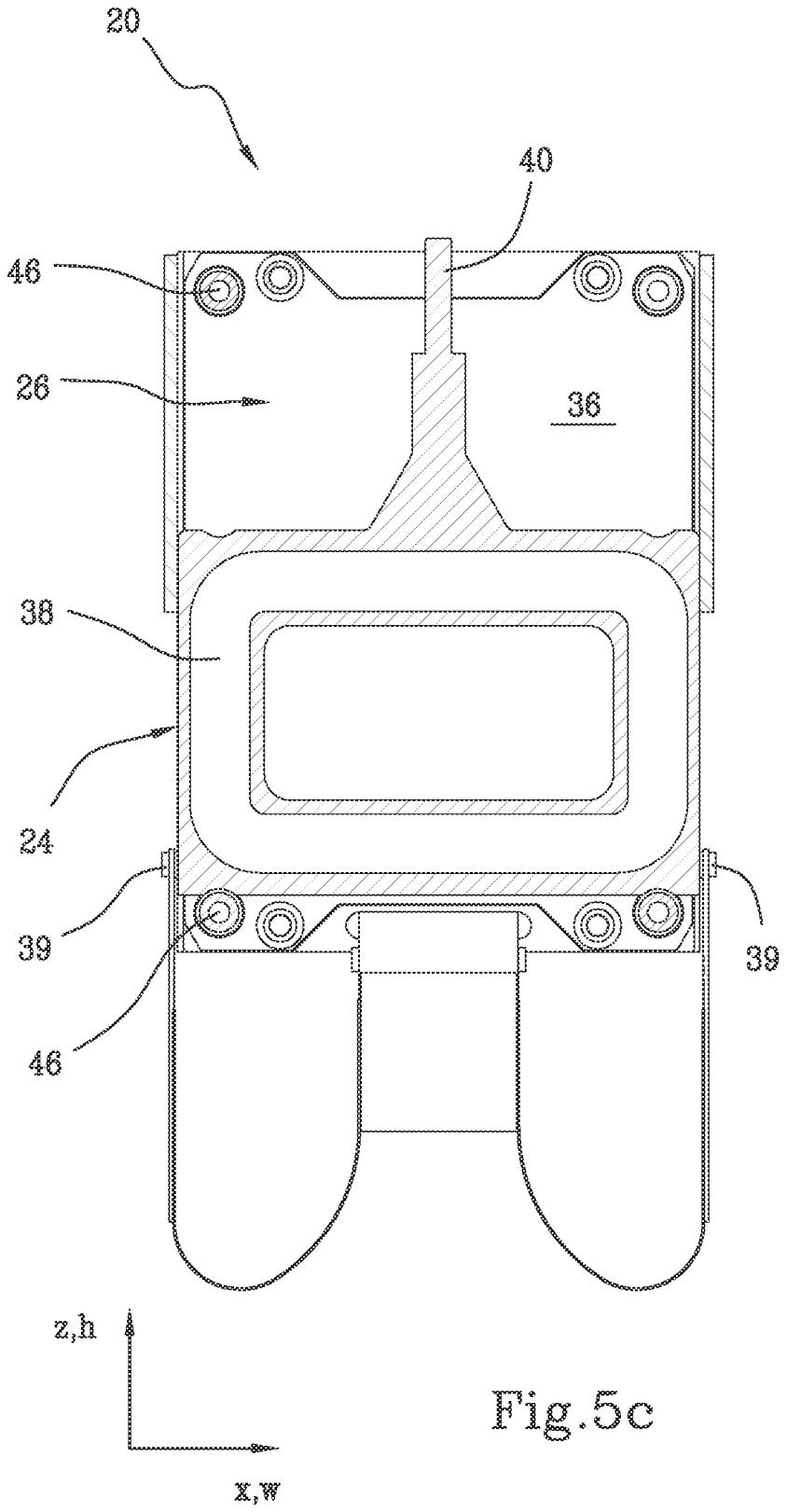
FIG. 5*c* shows the cross section of FIGS. 5*a* and 5*b*, at a different positioning of the spool with respect to the permanent magnets.

With respect to FIGS. 5*a*, 5*b*, and 5*c*, each of the n spools 24 comprises at least one winding 38, each of which consists of one wire forming a plurality of concentric and coplanar loops. Preferably the wire has a rectangular cross section, in order to maximize the metal density in the winding 38.

Figure 8:
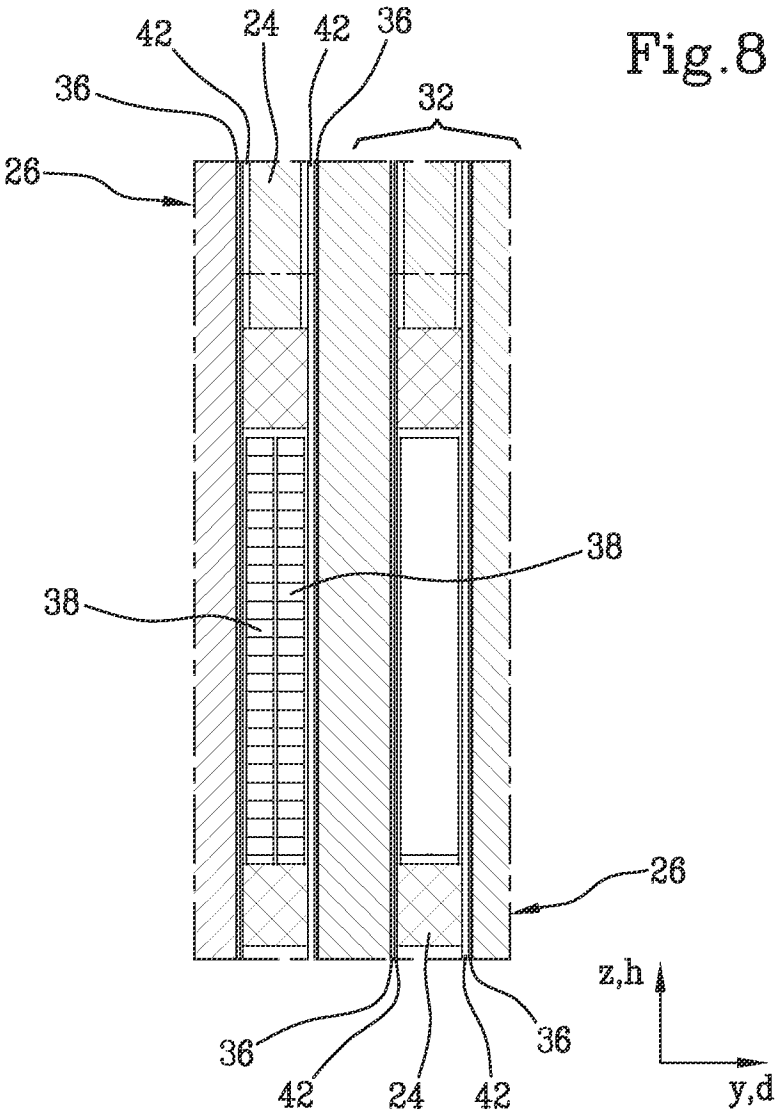
FIG. 8 shows an enlarged view of a detail similar to the one indicated with VIII in FIG. 7.
Figure 9:
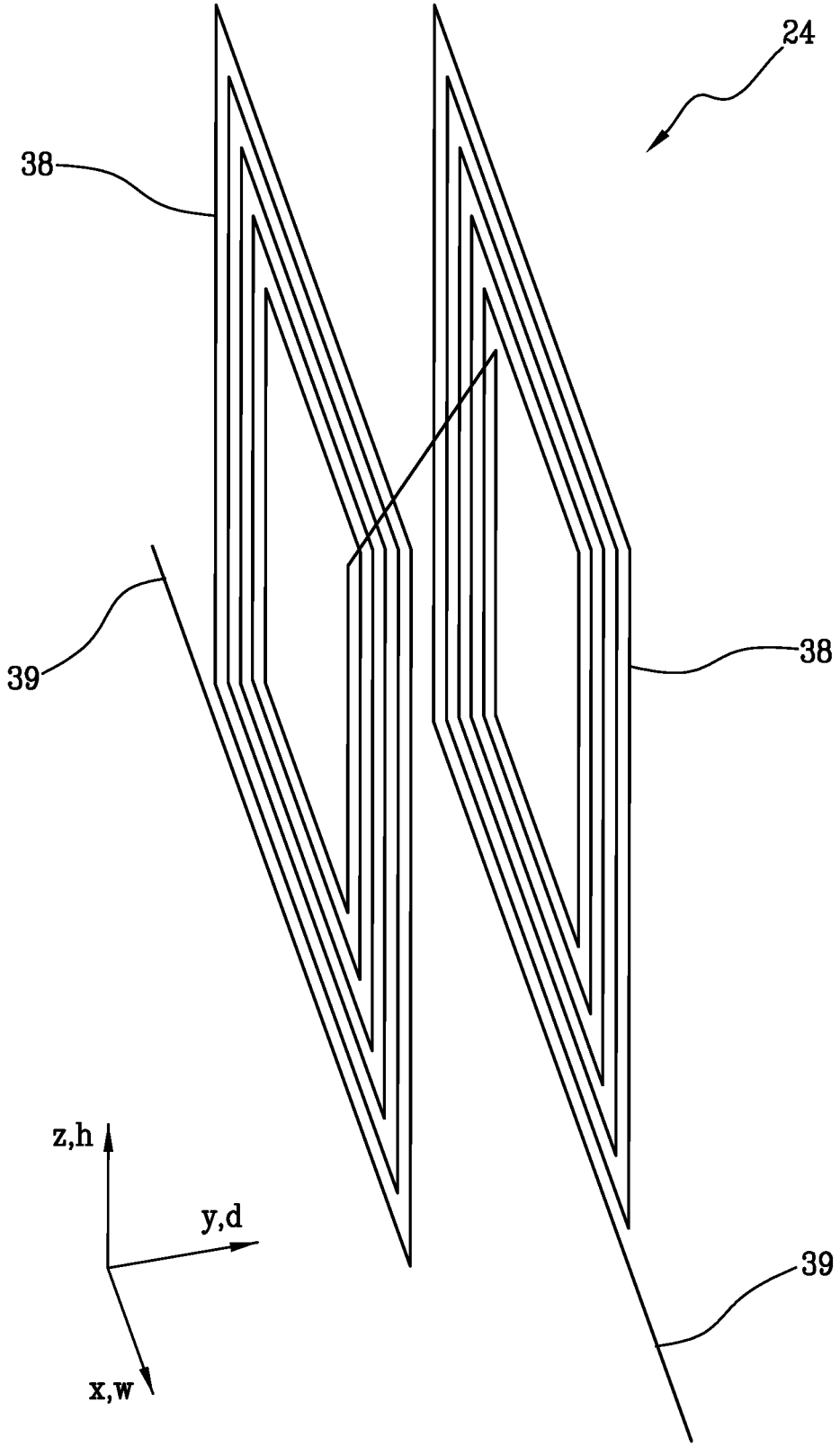
FIG. 9 schematically shows a possible arrangement of the windings in a spool according to the invention.

Preferably, each spool 24 comprises two windings 38 placed the one next to other along depth d (see FIG. 8). In particular, with specific reference to the schematic view of FIG. 9, the two windings 38 are electrically connected the one to the other at their respective innermost loops, such that the external electric connections 39 are available at their periphery on opposite sides along the width direction w, without any portion of wire overlapping the windings 38.

Each spool 24 has a prevailing development in the plane xz. In particular, the spools 24 have width along width w and height along height h remarkably larger than their depth along depth d. Preferably the spools 24 have an overall rectangular shape. Therefore, in each loop and in each spool 24, two horizontal segments (mainly arranged along x or width) and two vertical segments (mainly arranged along z or height) can be identified. As already mentioned above, each spool 24 can be electrically powered in two opposed ways, i.e., again with respect to FIGS. 5*a*, 5*b*, and 5*c*, the spool 24 can be powered such that an electric current circulates in clockwise direction (clockwise power) or, alternatively, such that an electric current circulates in counterclockwise direction (counterclockwise power). It is worth to be noted that, according to the arrangement disclosed above, by powering the external electric connections 39 of one spool 24, both its windings 38 are run by the electric current in the same direction (either clockwise or counterclockwise).

As the skilled person well knows, when the spool 24 is powered in such a manner that an electric current circulates in it, it generates a magnetic field perpendicular to the plane of the drawing. More in particular, when the spool 24 is powered clockwise, due to the right hand rule, it generates a magnetic field entering the plane of the drawing. Vice versa, when the spool 24 is powered counterclockwise, due to the right hand rule, it generates a magnetic field exiting the plane of the drawing.

Since each spool 24 is received between two adjacent magnetic plates 26, it is immersed in the static magnetic field generated by the permanent magnets 28, 30. When the spool 24 is not powered, it can be in the equilibrium position represented in FIG. 5*b*. When the spool 24 is powered, for example with a clockwise power, it tends to move to the position where its own entering magnetic field aligns as much as possible with the entering magnetic field generated by the permanent magnets, for example moving to the upper position represented in FIG. 5*a*. Vice versa, when the spool 24 is powered in the opposite way, i.e. with a counterclockwise power, it tends to move to the position where its own exiting magnetic field aligns as much as possible with the exiting magnetic field generated by the permanent magnets, in the example moving to the lower position represented in FIG. 5*c*.

In this manner, as the skilled person can understand, by means of electrical power, the movement of the spools 24 can be controlled, each one independently from the others. In particular, the actuator assembly 20 of the invention preferably comprises one electric circuit for powering each spool 24, wherein all the electric circuits for powering the spools 24 are controlled by an electronic control unit. In this manner it is possible to control the movement of every single heddle frame in order to reproduce a predetermined weaving pattern.

Preferably, each linear actuator 32 comprises stops arranged so as to stop the movement of the spool 24 before any of its portions goes above the upper permanent magnets 28 or below the lower permanent magnets 30.

Preferably each spool 24 comprises a connecting rod 40 extending along height h. The connecting rod 40 of each spool 24 is intended to be mechanically connected to a respective heddle frame, in order to transmit the movement of the spool 24 to the heddles and to the warp threads.

Advantageously, all the connecting rods 40 of all the spools 24 extend in the same direction, for example in the embodiments shown in the attached figures, all the connecting rods 40 of all the spools 24 extend upward.

Figure 1:
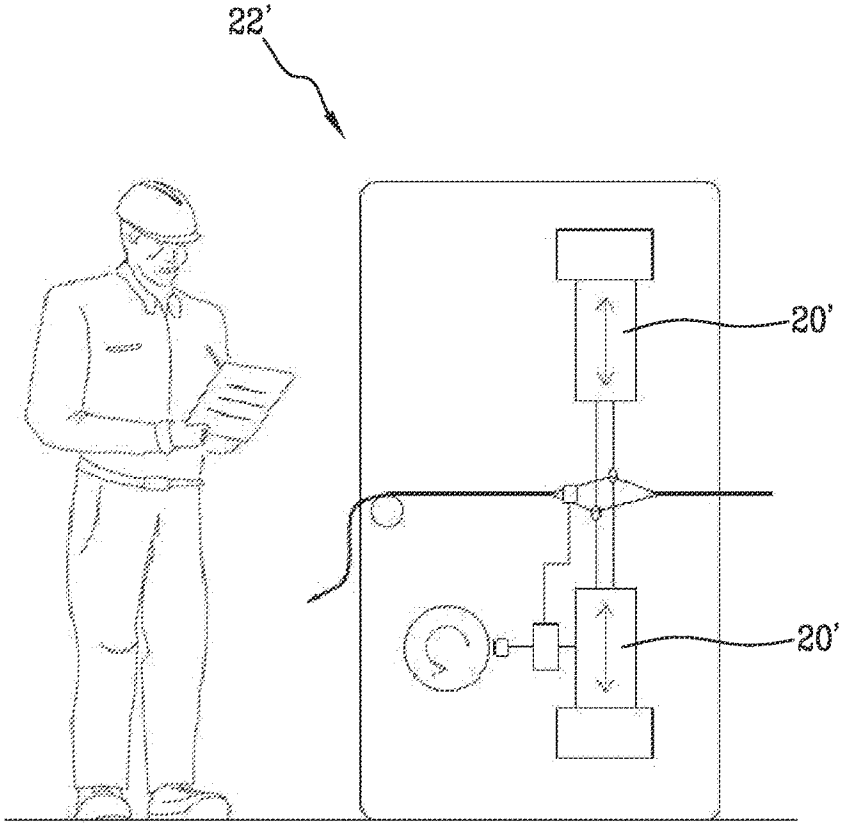
Fig.1 PRIOR ART
FIG. 1 schematically shows a side view of a ribbon weaving machine according to the prior art.
Figure 3:
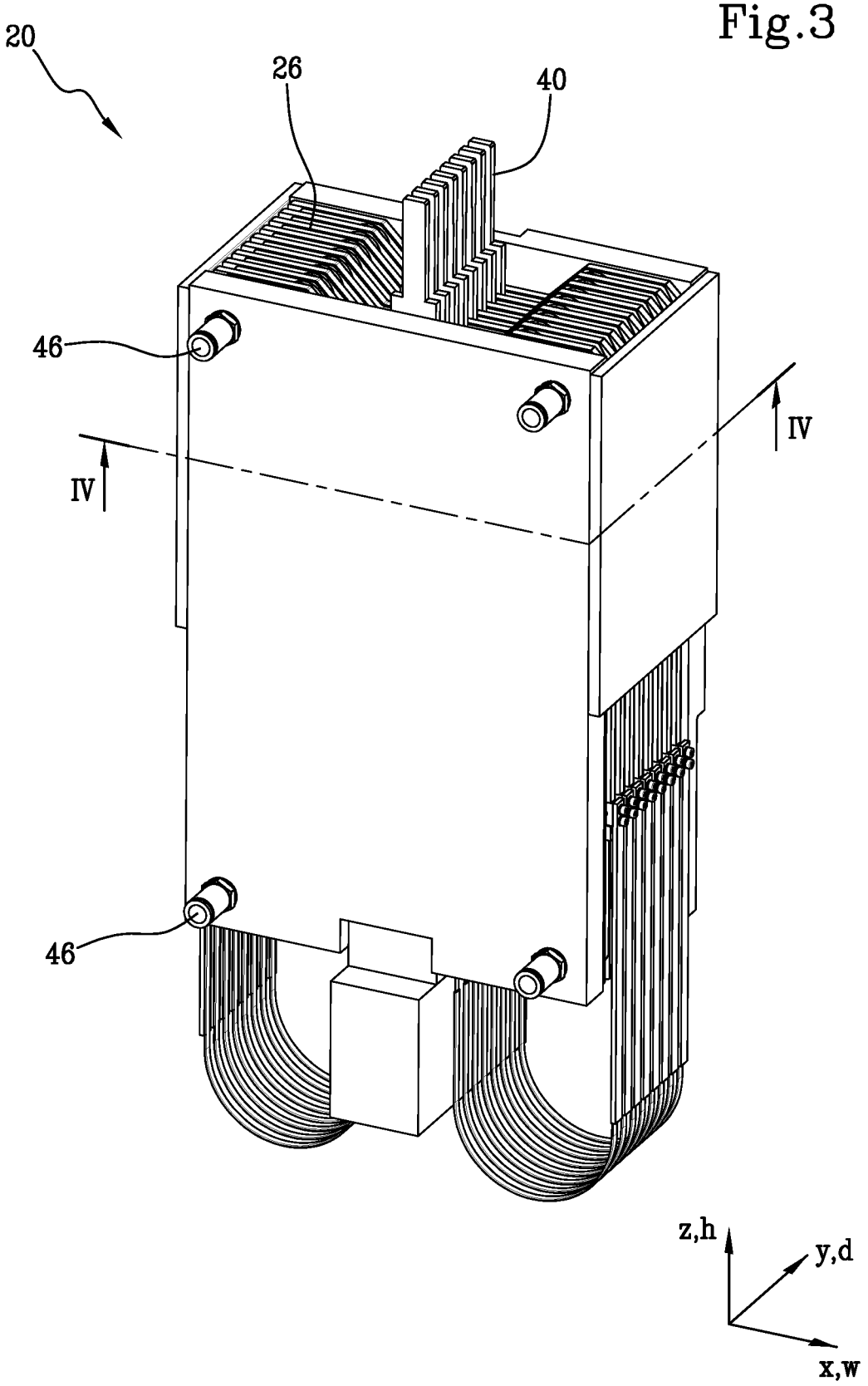
FIG. 3 shows an axonometric view of an actuator assembly according to the invention.
Figure 4:
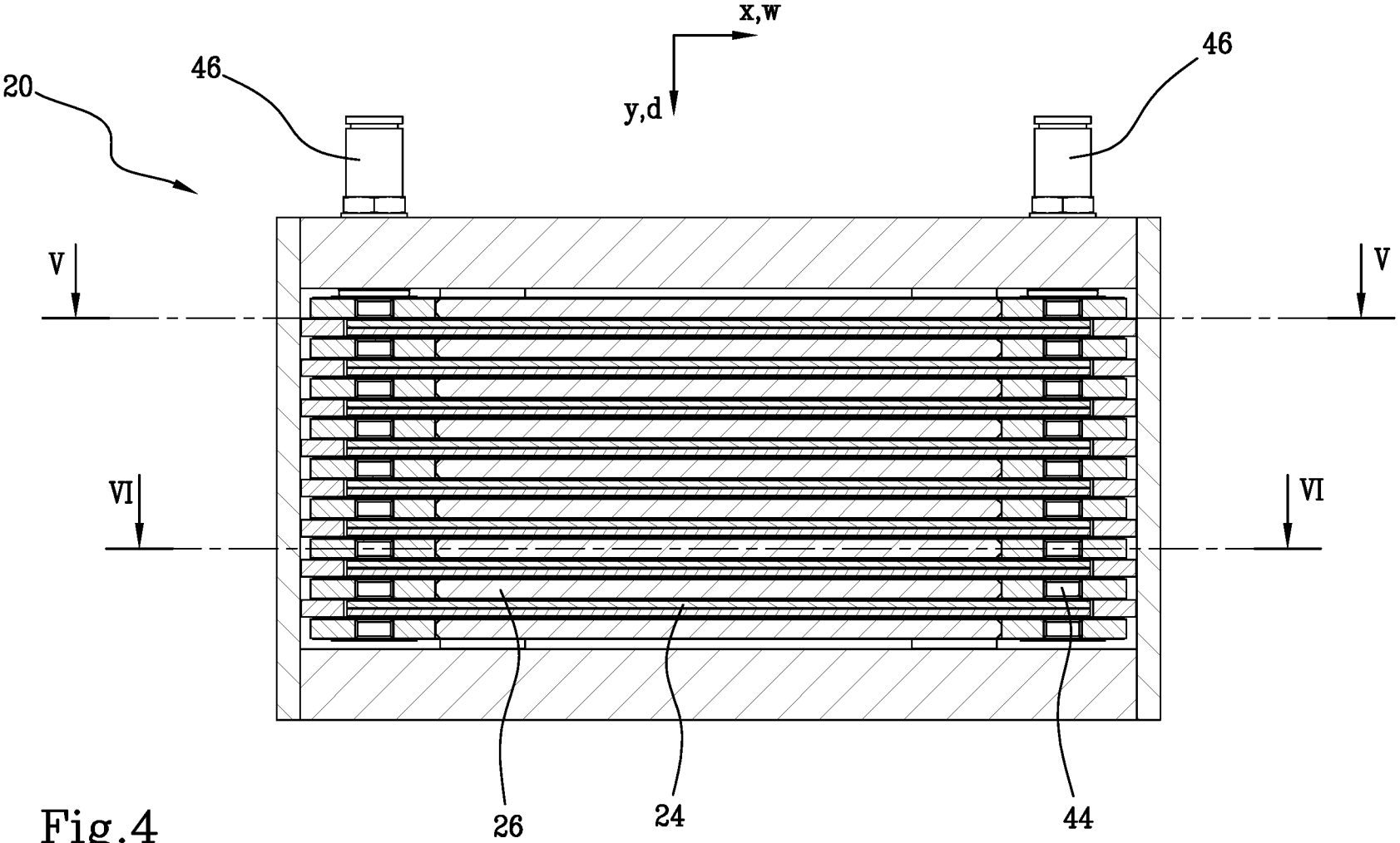
FIG. 4 shows a view of the cross section taken along lines IV-IV of FIG. 3 and of FIG. 6.

As the skilled person can easily understand, this particular arrangement of the spools 24 allows to remarkably reduce the overall height of the actuator assembly 20 of the invention with respect to the height of the corresponding actuator assemblies of the prior art. In this respect FIGS. 1 and 2 can be compared the one with the other, which are drawn schematically but with the same scale.

During operation of the actuator assembly 20 a remarkable quantity of heat develops in the spools 24, mostly due to Joule heating. Removal and dissipation of such heat are necessary for maintaining the temperature of the permanent magnets 28, 30 within the operating range. As a matter of fact, the characteristics of the permanent magnets 28, 30 are affected by increasing temperature and, in some cases, a threshold temperature exists beyond which they definitively demagnetize.

In the solutions of the prior art, the alternated arrangement of the spools (half above and half below the heddles) implies a relatively low density in the distribution of the magnetic plates and of the spools along depth. In other words, in the known solutions producing a relatively low amount of heat per volume unit, the distance between two adjacent magnetic plates is such that, even in presence of the spool, open gaps remain along which air is free to flow. In the solutions according to the prior art, air flow which spontaneously generates due to convection is sufficient for removing heat and for maintaining the magnets at a temperature suitable for operation.

As the skilled person can easily understand, the components of the actuator assembly 20 of the invention are arranged with a very greater density since all the spools 24 are arranged at the same height along a depth which is smaller or equal than the depth of an analogous actuator assembly 20' of the textile machine 22' of the prior art. Accordingly, in the invention, a higher amount of heat is produced per volume unit while open gaps 42 in the actuator assembly 20 are very narrow (see FIG. 8). This is why the air flow which spontaneously generates due to convection can be insufficient for ensuring a proper cooling.

Therefore, the actuator assembly 20 of the invention preferably comprises a cooling circuit which is described below.

Preferably the magnetic plates 26 comprise cooling channels 44 suitable for housing circulation of a cooling liquid. FIG. 6 shows an embodiment of a magnetic plate 26, in which two cooling channels 44 are obtained in the frame structure 34 and mainly develop along the direction of height h. In this embodiment the cooling circuit also comprises manifolds 46, easily visible in FIG. 7, which mainly develop along depth d of the actuator assembly 20. The manifolds 46 allow circulation of cooling liquid in all the cooling channels 44.

Furthermore, the cooling circuit comprises other components outside the actuator assembly 20 (not shown in the figures). Preferably the cooling circuit also comprises a reservoir, a cooler, supply and return ducts, a circulation pump and a control unit.

In case the actuator assembly 20 comprise the cooling circuit, it is preferable that the frame structures 34 of the magnetic plates 26 are made of a material which ensures a good heat transmission. For example, the frame structures 34 can be made with a thermally conductive polymer, a thermally conductive composite or aluminium.

Preferably, each magnetic plate 26 of the invention is arranged in such a manner to maximize the contact area between the permanent magnets 28, and the frame structure 34. For example, the frame structure 34 can comprise two rectangular windows in which permanent magnets 28, 30 are housed with little interference, so as to obtain an actual contact all along their periphery. Alternatively or additionally, heat conductive paste or heat conductive glue can be used for thermally and mechanically connecting the permanent magnets 28, 30 to the respective frame structure 34.

In this respect, as briefly reported above, also the metal foils 36 can cooperate in spreading heat so as to avoid undesirable temperature peaks. The shape and the disposition of the cooling channels 44 in each magnetic plate 26 have to be defined in such a manner to optimize heat removal and to avoid interference with operation of the linear actuator 32.

According to the embodiment shown in FIG. 6, the cooling channels 44 of two adjacent magnet plates 26 are arranged in proximity of the vertical segments of the spool 24 comprised therebetween, where a large quantity of heat develops. In this manner the cooling liquid circulating in the cooling channels 44 allows removal of the heat in an efficient manner, before it undesirably raises the temperature of the permanent magnets 28, 30.

According to some embodiments, the cooling channels 44 have a shape studied for maximizing their inner surface, so as to optimize the heat exchange between the cooling liquid and the walls of the cooling channel 44. For example, the cooling channels 44 can have a meandering shape.

In some embodiments, in addition to the liquid cooling circuit, the actuator assembly 20 can also comprise a forced ventilation system (not shown in the figures). For example, a fan can be placed below the actuator assembly 20, so as to create a forced air flow which passes through the open gaps 42 removing an additional amount of heat. The presence of the forced ventilation can be advantageous also for removing yarn and fibre debris which unavoidably accumulate in proximity of the working area after a prolonged operation of the textile machine 22.

Proper heat dissipation allows to obtain optimal performance in terms of speed and frequency for the movement of the spools 24.

According to what is described above, it can be understood that the springs are not necessary for proper operation of the actuator assembly 20 of the invention. However, in order to meet specific needs, it is possible to add also the springs, similarly to what is done in the solutions of the prior art.

However, instead of the springs, a different solution is preferably adopted. Preferably, the electric circuit for powering each spool 24 comprises a capacitor. The capacitor is suitable for constituting a temporary reserve of electric power to be provided to the spool 24. In particular, during the steady state operation in which the spool 24 continuously moves between the lower position and the upper position, while the spool 24 passes through the equilibrium position (the one of FIG. 5*b*) it has its maximum kinetic energy. Kinetic energy becomes null when the spool 24 temporarily stops, for example in the upper position (the one of FIG. 5*a*). While kinetic energy decreases, the capacitor is charged, so as to constitute a reserve of energy in the form of electric power. Subsequently, when the spool 24 has to move toward the lower position (the one of FIG. 5*c*), the capacitor dispenses the collected energy thus powering the spool 24 and transforming electric power into kinetic energy. In other words, kinetic energy of the spool 24 has its maximum in the equilibrium position and is null in the upper and lower positions, while the energy collected in the capacitor is null in the equilibrium position and has its maximum in the upper and lower positions.

In this manner the capacitor carries out a function similar to the one of the springs, accumulating energy while the spool 24 moves away from the equilibrium position and giving it back when the spool 24 goes again towards the equilibrium position. It is to be noted also that, differently from the springs, each capacitor is connected to the respective spool 24 only in an electric manner and thus it can be placed inside the textile machine 22 with great design freedom. Both for this reason and for their smaller sizes, the use of capacitors instead of springs allow to optimize the encumbrance of the actuator assembly 20 inside the textile machine 22.

The presence of the capacitors allows to reduce the amount of electric power which has to be taken from the power grid for operating the linear actuators 32.

The preceding description goes into details of the technical features which distinguish the invention with respect to solutions of the prior art. For all the other features, which can be common both to the prior art and to the invention, reference can be made to the introduction where the prior art is described and commented.

As the skilled person can easily understand, the invention allows to overcome the drawbacks pointed out above with respect to the prior art.

In particular, the present invention provides an actuator assembly 20 for a textile machines 22, having an overall size smaller than the known ones. In particular the reduced depth d of the actuator assembly 20 allows to reduce also the vertical stroke of the linear actuators 32 required for a shedding formation. In turn, the reduced vertical stroke allows to reduce the related energy which is lost in the form of heat.

Lastly, the present invention provides an actuator assembly 20 for textile machines 22, which, further to allow the advantages described above, also maintains the functionality of the known solutions.

It is clear that specific features are described with respect to different embodiments of the invention with an exemplifying and non-limiting intent. Obviously, a skilled technician will be able to bring further changes and modifications to the present invention, in order to meet specific and contingent needs. For example, the technical features described with respect to one embodiment of the invention can be extrapolated from it and applied to other embodiments of the invention. Such changes and modifications are in any case comprised within the scope of protection of the invention, as defined by the following claims.

What is claimed is:

1. Actuator assembly for a textile machine, having a width w, a depth d and a height h, wherein:

the actuator assembly comprises a plurality n of spools distributed along the depth d;

the actuator assembly comprises a plurality n+1 of magnetic plates distributed along the depth d;

the magnetic plates and the spools are alternated along the depth d such that each spool is received between two adjacent magnetic plates;

each magnetic plate comprises an upper permanent magnet and a lower permanent magnet having opposed orientation;

the upper permanent magnets of all the magnetic plates have the same orientation;

the lower permanent magnets of all the magnetic plates have the same orientation;

each spool is movable along the height h between an upper position and a lower position and vice versa, wherein the upper position is at least partially comprised between the upper permanent magnets of the two adjacent magnetic plates and the lower position is at least partially comprised between the lower permanent magnets of the two adjacent magnetic plates; and each spool can be electrically powered in two opposed ways.

2. The actuator assembly according to claim 1, wherein each magnetic plate comprises a respective frame structure inside which the respective permanent magnets are mounted.

3. The actuator assembly according to claim 2, wherein each respective frame structure comprises two rectangular windows in which the respective permanent magnets are housed with little interference.

4. The actuator assembly according to claim 2, wherein the respective permanent magnets are thermally and mechanically connected to the respective frame structure by means of heat conductive paste or heat conductive glue.

5. The actuator assembly according to claim 1, wherein each magnetic plate comprises two metal foils covering the respective permanent magnets.

6. The actuator assembly according to claim 1, wherein each spool comprises a connecting rod extending along the height h and intended to be mechanically connected to a respective heddle frame.

7. The actuator assembly according to claim 6, wherein all the connecting rods of all the spools extend in the same direction.

8. The actuator assembly according to claim 1, further comprising a cooling circuit and wherein each of the magnetic plates comprise cooling channels suitable for housing circulation of a cooling liquid.

9. The actuator assembly according to claim 8, wherein each spool comprises two vertical segments mainly arranged along the height h and wherein, in two adjacent magnet plates, the cooling channels are arranged in proximity of the vertical segments of the spool comprised therebetween.

10. The actuator assembly according to claim 1, further comprising a forced ventilation system.

11. The actuator assembly according to claim 1, wherein each spool comprises at least one winding consisting of one wire forming a plurality of concentric and coplanar loops.

12. The actuator assembly according to claim 11, wherein the wire has a rectangular cross section.

13. The actuator assembly according to claim 11, wherein each spool comprises two windings placed the one next to other along the depth d.

14. The actuator assembly according to claim 13, wherein the two windings are electrically connected the one to the other at their respective innermost loops, such that external electric connections are available at the periphery of the two windings on opposite sides along a width of the two windings.

15. The actuator assembly according to claim 1, comprising, per each spool, a powering electric circuit comprising a capacitor.

16. The actuator assembly according to claim 1, comprising linear actuators, each comprising one of said spools and two of said magnetic plates adjacent thereto, wherein said magnetic plates are each part of two linear actuators at the same time.

17. The actuator assembly according to claim 1, wherein within a depth of each magnetic plate a depth of the respective permanent magnets is comprised.

18. The actuator assembly according to claim 1, wherein magnetic fields generated by each of the upper permanent magnets and by each of the lower permanent magnets close the one on the other outside the actuator assembly.

19. The actuator assembly according to claim 1, wherein each magnetic plate has a prevailing development in a plane and comprises two metal foils which extend parallel to said plane and cover the respective permanent magnets.

20. Textile machine comprising the actuator assembly according to claim 1.

21. The textile machine according to claim 20, wherein the textile machine is a ribbon weaving machine.

* * * * *